United States Patent [19]

Hutchins

[11] 4,091,576

[45] May 30, 1978

[54] RETENTION OF ABRASIVE SHEET MATERIAL ON AN ABRADING TOOL

[76] Inventor: Alma A. Hutchins, 49 N. Lotus Ave., Pasadena, Calif. 91107

[21] Appl. No.: 694,457

[22] Filed: Jun. 9, 1976

Related U.S. Application Data

[63] Continuation-in-part of Ser. No. 655,992, Feb. 6, 1976, abandoned.

[51] Int. Cl.[2] ..... B24B 23/00; B24D 17/00

[52] U.S. Cl. ..... 51/170 TL; 51/386

[58] Field of Search ..... 51/170 R, 170 TL, 170 MT, 51/175, 358, 382, 386, 387, 328

[56] References Cited

U.S. PATENT DOCUMENTS

| | | | |
|---|---|---|---|
| 2,070,712 | 2/1937 | Davis | 51/386 |
| 2,517,548 | 8/1950 | Dobson | 51/170 TL |
| 2,721,427 | 10/1955 | Dremel | 51/170 TL |
| 2,743,557 | 5/1956 | Larson | 51/170 TL |
| 2,893,177 | 7/1959 | Bruck | 51/170 MT |
| 3,892,091 | 7/1975 | Hutchins | 51/170 TL |

FOREIGN PATENT DOCUMENTS

| | | | |
|---|---|---|---|
| 491,009 | 3/1953 | Canada | 51/386 |

*Primary Examiner*—Harold D. Whitehead
*Assistant Examiner*—Nicholas P. Godici
*Attorney, Agent, or Firm*—William P. Green

[57] ABSTRACT

A sanding tool having a power driven shoe carrying a sheet of abrading material which is adhesively secured to the underside of the shoe and then extends upwardly at its forward end and then rearwardly at the top of the shoe to a position of retention of an end portion of the sheet between a spring urged clamping element and an opposed surface. The clamping element is urged toward that surface with a very light yielding force which remains the same during insertion of the sheet material as during an abrading operation, and which is light enough to enable the sheet to be pushed manually rearwardly between the clamping element and opposed surface against the frictional resistance offered thereby.

22 Claims, 9 Drawing Figures

RETENTION OF ABRASIVE SHEET MATERIAL ON AN ABRADING TOOL

CROSS REFERENCE TO RELATED APPLICATION

This application is a continuation-in-part of my copending application Ser. No. 655,992 filed Feb. 6, 1976 on "Retention of An Adhesive Backed Abrading Sheet on an Abrading Tool" now abandoned.

BACKGROUND OF THE INVENTION

This invention relates to portable abrading tools including a shoe carrying a sheet of abrasive material, such as sandpaper, to be utilized in performing a work abrading operation.

In conventional portable sanding tools, one of the most common methods of attaching the sandpaper to a shoe of the tool has been by the use of spring clips attached to the upper side of the shoe at its opposite ends. These clips are manually actuable to a released position in which they allow reception of an end of the sandpaper sheet adjacent or in engagement with the clip, following which the clip is released to return by spring force to an active position in which it grips the paper tightly and retains it against detachment from the shoe. Numerous variations of these spring clip retaining units have been proposed and utilized in the past, but in each the manual manipulation of the clips has entailed some inconvenience and more expenditure of time than would be desired upon each change of paper, and in many instances the ultimate retention has been of less than optimum effectiveness. Some typical examples of prior manually actuable spring clips of this general type are found in U.S. Pat. Nos. 2,509,561, 2,639,564, 2,683,337, 2,735,241, 2,848,850, 2,893,174, 3,183,638, 3,267,622, 3,349,523 and 3,546,822.

Another prior arrangement for detachably securing a sheet of abrasive material to a sander shoe is by use of an adhesive material between the paper and the underside of the shoe, which material may be a layer of pressure sensitive adhesive carried by the back side of the sandpaper sheet and adapted to adhere to the undersurface of a cushion, and after use be stripped from that undersurface for replacement by another self-adhesive sandpaper sheet. In my prior U.S. Pat. No. 3,892,091, I have disclosed an arrangement utilizing such a self-adhesive sheet of abrading material which extends along and is adhered to the undersurface of the shoe and at the forward end of the shoe extends upwardly and then rearwardly into a locating recess formed at the upper side of the forward portion of the shoe. This locating recess is of fixed dimension, and coacts with the adhesive attachment of the sheet to provide a combined retention system for holding the forward portion of the sheet in a position of extension about the forward portion of the shoe.

SUMMARY OF THE INVENTION

A major purpose of the present invention is to provide an arrangement similar to that of my mentioned U.S. Pat. No. 3,892,091, in which an abrading sheet is secured to a shoe by dual retention, that is, by adhesive attachment to the underside of the shoe and mechanical retention at the upper side of the shoe near its forward end, but in which the connection of the sheet to the shoe is more positive and reliable than in the prior patent, and offers somewhat greater assurance that the forward upturned portion of the sheet will remain in proper position about the forward end of the shoe under all operating conditions, even though very substantial dislocating forces may be exerted against the sheet during an abrading operation. Particularly contemplated is a structure in which this extremely effective retention is attainable with sandpaper of any of various different thicknesses in a single sanding tool and without adjustment or change of any type in the attaching means. Further, these advantages are achieved without resorting to spring clips which must be manually released during attachment of a sheet to a sanding tool. An entire attaching operation can be formed by merely slipping an edge portion of a sandpaper sheet into a retained position, and then folding the sheet about the forward end of the sanding shoe and into adhesive engagement with its undersurface.

Structurally, an arrangement embodying the invention includes a spring urged clamping element at the upper side of the forward portion the shoe, which is so designed as to effectively confine and retain an edge portion of the sandpaper sheet in a relation resiliently gripping the sheet while in use, but with the clamping element and its mounting being specially constructed to give the element only a relatively light spring force which is purposely weak enough to enable insertion of an edge of the sandpaper sheet into a position of clamped retention by the retaining element without requiring release of that element to permit such insertion. The sandpaper sheet can then be grasped by a user at a lcoation forwardly of the clamping structure, and then pushed rearwardly into a space between the clamping element and an opposed coacting surface. The sheet is pushed rearwardly between the element and surface, in sliding engagement therewith, with the same relatively light spring force being exerted against the sheet during such sliding insertion as is applied to the sheet in its fully inserted position and during an actual abrading operation. The clamping element and its resilient mounting structure are preferably formed integrally as a single piece of sheet metal, having a mounting portion shaped to form at least one leaf spring for applying the desired light spring force to the portion of the device which functions as the clamping element. The element may have a forward portion disposed at a camming angle to be engaged and deflected by the sheet as it is inserted in order to enable movement of the sheet between the clamping element and opposed coacting clamping surface. A shoulder or shoulders are provided at the inner end of the space which receives the retained edge portion of the sandpaper sheet, to limit the insertion of the sheet at a predetermined location. In one form of the invention, these shoulder means are formed on the movable spring urged clamping portion of the device, and may take the form of one or more lugs projecting downwardly into coacting recesses in the shoe, in a relation locating that clamping portion in a predetermined orientation with respect to the shoe. In another presently preferred arrangement, the device has a plurality of relatively narrow laterally spaced leaf spring portions (desirably two) which extend between a fixed anchoring portion of the clip and a movable spring urged clamping portion, and the shoulder or shoulders for limiting inserting movement of the sandpaper sheet are carried by the mentioned anchoring portion, preferably being formed on fingers which project forwardly from the anchoring portion at locations offset laterally from the leaf spring means.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
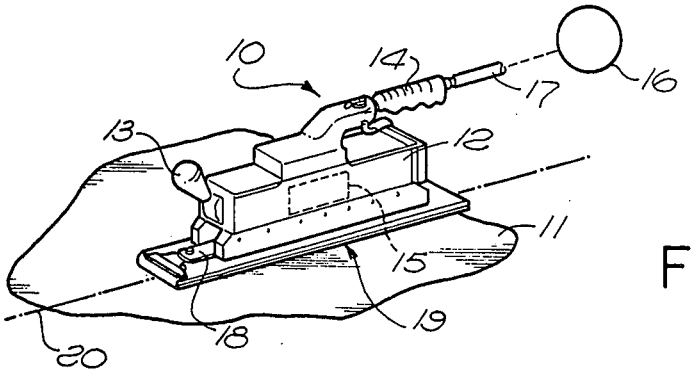
FIG. 1 is a perspective view of a first form of powered sander constructed in accordance with the invention.

Describing first the form of the invention shown in FIGS. 1 to 5, there is represented generally at 10 in FIG. 1 a portable sander, which is illustrated and will be described as it appears when sanding an upwardly facing horizontal work surface 11. Tool 10 typically includes a main body section 12 to which a pair of front and rear handles 13 and 14 are mounted for holding and manipulating the tool. The body 12 contains a motor diagrammatically represented at 15 driven by power from an appropriate source 16, which may typically be a source of compressed air from which air to drive the motor 15 is delivered through a flexible hose 17. When energized, the motor 15 drives a part 18 relative to body 12, with this part 18 being secured to and driving a shoe 19. In the particular arrangement illustrated, it is assumed that parts 18 and 19 are driven in a reciprocating motion relative to body 12, along a front to rear axis of the tool represented at 20, which axis is horizontal and parallel to surface 11 in the FIG. 1 position of the tool. It is also contemplated, however, that the invention may be applied to tools in which the working shoe is driven in other than a straight line reciprocating motion. For example, parts 18 and 19 may be driven orbitally relative to the body of the tool, as in many known types of power sanders.

Part 18 may be an essentially flat horizontal plate whose opposite side edges are received within guideways carried by body 12 in a relation guiding part 18 and the attached shoe 19 for only the desired reciprocating movement relative to body 12. Part 18 is appropriately rigidly secured to shoe 19, as by screws 21 received within registering openings in the parts 18 and 19 near their opposite ends and carrying nuts 22.

The shoe 19 includes an upper essentially rigid backing plate 23 and a resiliently deformable cushion 24 secured to the underside of plate 23 by an appropriate adhesive material. Plate 23 may be stamped from sheet metal, preferably sheet aluminum, and have parallel planar horizontal upper and lower surfaces 25 and 26. The plate may be of rectangular horizontal section, having parallel opposite edges 27 and 28, a front edge 29 disposed perpendicular to edges 27 and 28 and perpendicular to the front to rear axis 20 of the tool, and a rear transverse edge 30.

Cushion 24 has essentially the same rectangular peripheral outline configuration as plate 23, except that the cushion 24 desirably projects forwardly slightly beyond the forward end edge 29 of plate 23 (FIG. 4), to present a forwardly offset transverse vertical front face 31 of the cushion. The rear end face or surface 32 of the cushion may also be offset rearwardly beyond rear edge 30 of plate 23, with the two surfaces 31 and 32 both being disposed in planes perpendicular to the front to rear axis 20. Cushion 24 may be formed of an appropriate elastomeric material, such as neoprene rubber, and contains openings 33 providing access to the heads of screws 21 for securing shoe 19 to and detaching it from the reciprocating part 18. The undersurface 34 of cushion 24 lies generally within a horizontal plane parallel to that of backing plate 23, except that surface 34 is preferably irregularized rather than smooth, to provide across its entire horizontal area a large number of rather closely spaced recesses 35 and intermediate flat peaks or land areas 36.

The actual abrading operation on work surface 11 is performed by an abrading sheet 37, such as sandpaper, including the usual layer of relatively heavy backing paper 38, coated at one side by a layer of abrasive particles 39, and at its opposite side by a layer of pressure sensitive adhesive material 40. This material 40 is secured very tightly to the backing paper 38, and will adhere to the undersurfaces 36 and end surface 31 of cushion 24, but is adapted to be stripped from those cushion surfaces with the rest of the sandpaper sheet for removal and replacement. To optimize this stripping effect, the cushion 24 is for best results formed of a closed pore neoprene rubber.

Figure 2:
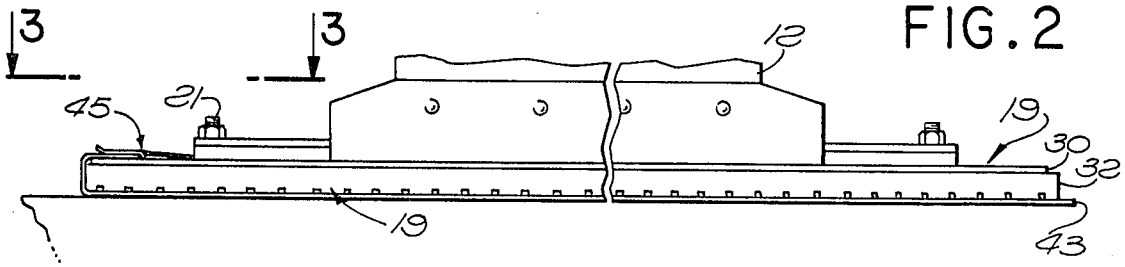
FIG. 2 is an enlarged fragmentary side view of the FIG. 1 sander.

Sandpaper sheet 37 is of rectangular configuration, having a width *w* corresponding to that of shoe 19, so that the opposite side edges 27′ and 28′ of the paper may lie in essentially the same vertical planes as the opposite side edges 27 and 28 of plate 23. The sandpaper sheet 37 has a length in the direction of front to rear axis 20 which is greater than the length of shoe 19, so that the forward portion of the sandpaper can extend upwardly at 41 past and in engagement with forward surface 31 of the cushion, and then extend rearwardly at 42 along the forward portion of the upper surface 25 of the backing plate 23 of the shoe. The rear edge 43 of the sandpaper may terminate just slightly beyond the rear end of the shoe (FIG. 2). This rear edge 43 and the forward end edge 44 of the sandpaper sheet are perpendicular to the opposite side edges 27′ and 28′ of the sheet, and extend transversely of the front to rear axis of the tool.

Figure 3:
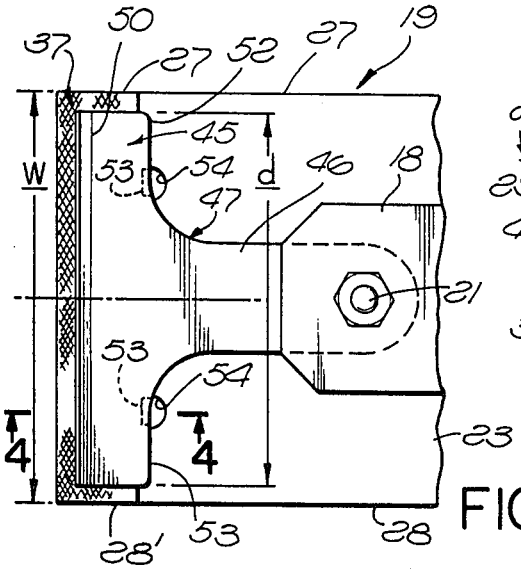
FIG. 3 is a fragmentary plan view taken on line 3—3 of FIG. 2.
Figure 4:
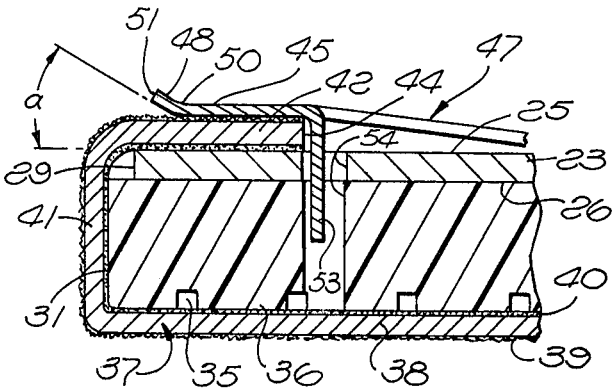
FIG. 4 is a further enlarged fragmentary vertical section taken on line 4—4 of FIG. 3.

The forward end portion 42 of sandpaper sheet 37 is retained in its FIG. 4 position relative to the shoe by a clamping element 45 which is spring urged downwardly toward the upper surface 25 of the shoe by a leaf spring 46 secured at its rear end by one of the screws 21 to plate 23. The clamping element 45 and leaf spring 46 are desirably formed integrally of a single piece 47 of sheet form spring steel, stamped to the essentially T-shaped horizontal outline configuration shown in FIG. 3. When the sandpaper sheet 37 is not connected to the shoe, this part 47 returns by its own resilience to the position illustrated in FIG. 5, in which part 47 is planar except at the location of a forward camming portion 48, and is in engagement with the upper surface 25 of plate 23. The part 47 is deflectable upwardly by the sandpaper to the position of FIG. 4, against the resilience of the spring material of part 47, which then tends to return the part downwardly and thereby exerts a yielding clamping force against the sandpaper.

The leaf spring portion 46 of part 47 is relatively narrow, as seen in FIG. 3, and is centered with respect to the width of the shoe, and contains an opening 49 near its rear end through which an associated one of the screws 21 extends. The undersurface of part 18 may be recessed upwardly at 18' (FIG. 5), a distance corresponding to the thickness of part 47, so that both the part 18 and part 47 may engage the upper surface of shoe plate 23, and part 47 may be tightly clamped between part 18 and plate 23.

The forward portion of part 47 which forms the clamping element 45 is substantially wider than leaf spring portion 46, and in particular may have a width *d* almost as great as that of the shoe. This clamping element portion 45 may be rectangular as seen in plan view (FIG. 3). The inclined forwardmost edge portion 48 of part 47 extends upwardly at an angle *a* with respect to the horizontal planar upper surface 25 of plate 23, being bent with respect to the remainder of part 47 along a line 50 extending transversely of the shoe, and continuing upwardly and forwardly at angle *a* to an edge 51 which is also disposed transversely of the shoe and its longitudinal axis 20. The two rear edges 52 and 53 of clamping element portion 45 of part 47 (at opposite sides of the leaf spring portion 46) are aligned with one another and disposed transversely of axis 20 and the shoe, and may carry two lugs or fingers 53 projecting vertically downwardly from element 45 into two spaced openings 54 formed in plate 23 and cushion 24. These fingers 53 may be formed integrally with the rest of part 47, that is by bending downwardly portions of the sheet material of part 47, and are of a transverse width to fit fairly closely within openings 54 while being movable upwardly and downwardly therein as part 47 moves upwardly and downwardly. Fingers 53 have sufficient stiffness to effectively resist or prevent lateral movement of part 47 relative to the shoe, that is, pivotally about the axis of screw 21, so that the fingers act as locating elements to coact with screw 21 in maintaining part 47 in the proper illustrated orientation with respect to plate 23 of the shoe.

Figure 5:
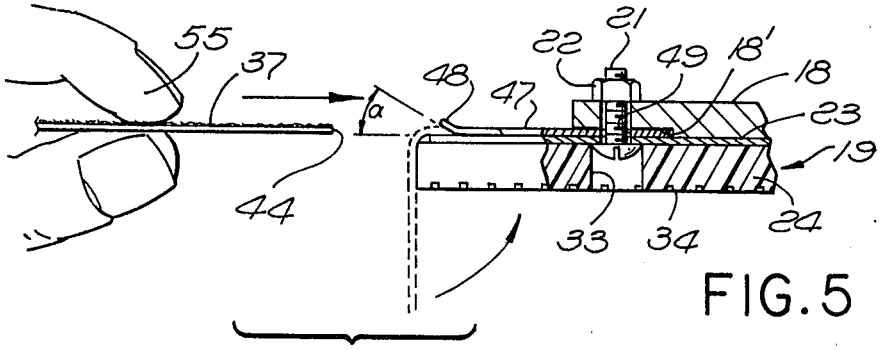
FIG. 5 is a fragmentary side view showing the manner of insertion of a sandpaper sheet beneath the clamping element.

To describe now the manner of application of sandpaper sheet 37 to shoe 19, assume that initially the sandpaper 37 is flat as illustrated in full lines in FIG. 5. In this condition, the sheet 37 is placed just forwardly of the forward edge of the clamping unit 47, with the sheet being grasped in a hand of a user as illustrated at 55, and with the edge 44 of sheet 37 disposed transversely of axis 20 of the tool. While holding the sheet 37 in this manner, the user pushes the sheet rearwardly (rightwardly in FIG. 5), along the upper surface 25 of the forward portion of plate 23, and until edge 44 engages the inclined camming entrance throat portion 48 of part 47. After thus contacting portion 48, the user continues to push the sheet manually in a rearward direction, to first deflect camming portion 48 and the connected clamping element portion 45 of part 47 upwardly as illustrated in FIG. 4, and then with the clamping element thus deflected to advance the sandpaper sheet rearwardly between part 47 and surface 25, in sliding engagement therewith, until edge 44 contacts the two lugs or fingers 53 at the rear of portion 45 of part 47. These fingers are aligned with one another transversely of the shoe, and consequently act to assure proper transverse alignment of edge 44 when it is in engagement with fingers 53. After reaching this fully inserted position of engagement with fingers 53, the sandpaper sheet is folded downwardly as represented in broken lines in FIG. 5, and into engagement with front edge surface 31 of cushion 24, following which the main portion of sheet 37 is folded rearwardly to the position of FIG. 4 in which adhesive material 40 contacts and adheres to the undersurface of cushion 24. This adhesive attachment of the sandpaper sheet to the undersurface of the cushion then coacts with the clamped retention of the edge portion 42 of the sandpaper sheet between the clamping element and upper plate 23 to very effectively and positively maintain the sandpaper on the shoe. The vertically extending forward portion 41 of the sandpaper sheet when thus retained can be moved forwardly into engagement with a work surface, in a manner enabling the tool to sand into corners and recesses, about irregularly shaped projections, etc. After the sandpaper sheet 37 has become worn, it may be easily removed by merely reversing the above described application process, to first peel the sandpaper away from surfaces 34 and 31 and to a flat forwardly projecting position, and then pull the sheet forwardly as viewed in FIG. 5 and out of its clamped engagement with part 47.

It is particularly noted and of considerable significance that the clamping force of unit 47 does not have to be released manually in order to allow movement of sheet 37 into or out of its holding position beneath element 47. This result is achieved by designing part 47 to exert only a relatively light downward clamping force toward plate 23 and against the sandpaper 37, which spring force is weak enough that sheet 37 can be pushed rearwardly in the manner discussed between part 47 and surface 25. The frictional resistance offered by part 47 and surface 25 to such rearward sliding movement of sheet 37 is small enough that it can easily be overcome by sheet 37 as it is pushed rearwardly; and that resistance does not cause distortion or unwanted deformation of sheet 37, which remains in essentially its illustrated planar condition during the entire insertion process and until it reaches the FIG. 4 position of engagement with fingers 53. It is found that the stiffness of a conventional sheet of sandpaper utilized in sanding tools of this type is great enough to allow such upward deflection of part 47 by the pushed sandpaper sheet, and allow full sliding insertion of the sheet to the FIG. 4 position. After such full insertion, the continued clamped retention of the sheet beneath part 47, though still under very light spring force the same as that which is present during the sliding movement of the sheet along the undersurface of portion 45 of part 47, is great enough, in conjunction with the adhesive attachment to the undersurface and forward end of the shoe, to effectively retain the sandpaper on the shoe in the FIG. 4 condition during an abrading operation. Also, the discussed manner of application of the sandpaper sheet, and its ultimate effectively clamped retention at 42, are attained for sandpaper sheets of various different thicknesses, since for any thickness the part 47 will exert some clamping force against the sheet, in view of the fact that part 47 tends to normally return all of the way downwardly into engagement with upper surface 25 of plate 23. It is contemplated that perhaps in some instances portion 45 of part 47 might be spaced slightly from surface 25 when sheet 37 is not present, so long as the spacing between portion 45 and surface 25 is less than the thickness of the sheet to be gripped, but in most instances it is preferable that portion 45 actually tend to return downwardly to a normal position of direct engagement with surface 25. When the sandpaper sheet 37 is ultimately pulled forwardly from beneath clamping element 45 for removal and replacement, the same clamping force is exerted against the sheet during such removal as during the discussed rearward insertion, and during an abrading operation, but again is light enough to permit such removal without actuation of the clamping element to released condition.

To now describe the second form of the invention illustrated in FIGS. 5 to 9, the overall construction of the power sander 10*a* which is illustrated only fragmentarily in those figures may typically be considered as identical with the structure of the sander 10 of FIGS. 1 to 5, except for the substitution of a changed clip part or clamping unit 47*a* for the part 47 of FIGS. 1 to 5. The reciprocating sanding shoe 19*a* of FIGS. 6 to 9, including the rigid upper backing plate 23*a* and resiliently deformable cushion 24*a*, as well as the sandpaper sheet 37*a* consisting of paper 38*a*, abrasive particles 39*a* and layer 40*a* of pressure sensitive adhesive material, may all be the same as the corresponding parts 19, 23, 24, 37, 38, 39 and 40 of the first form of the invention.

Figure 6:
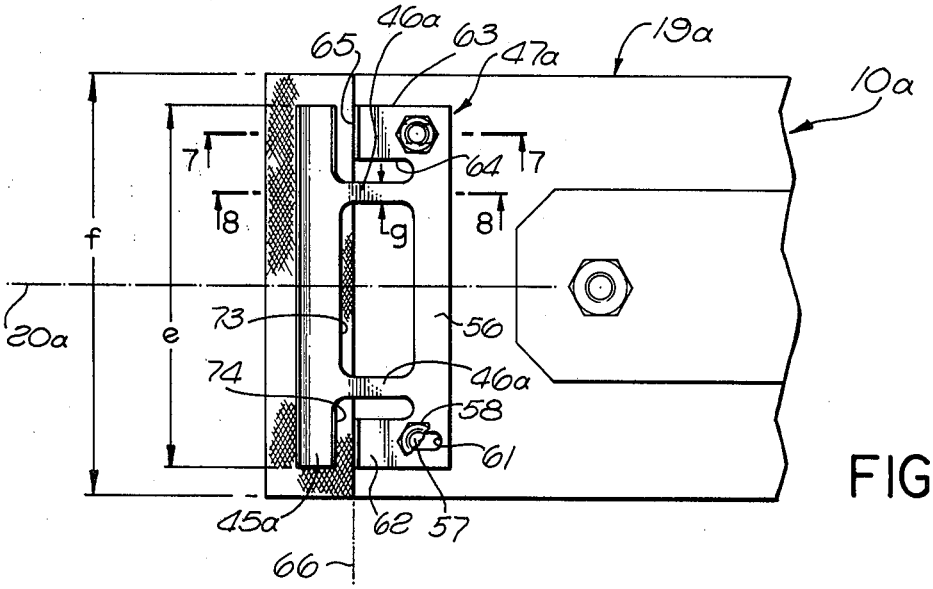
FIG. 6 is a fragmentary plan view similar to FIG. 3, but showing a variational form of the invention.
Figure 7:
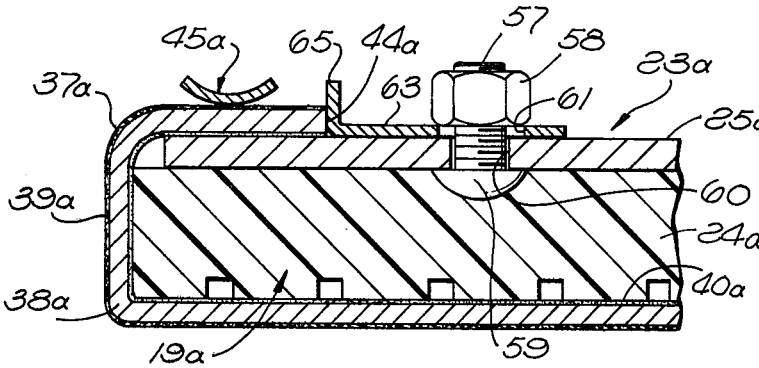
FIGS. 7 and 8 are enlarged vertical sections taken on lines 7—7 and 8—8 respectively of FIG. 6.
Figure 8:
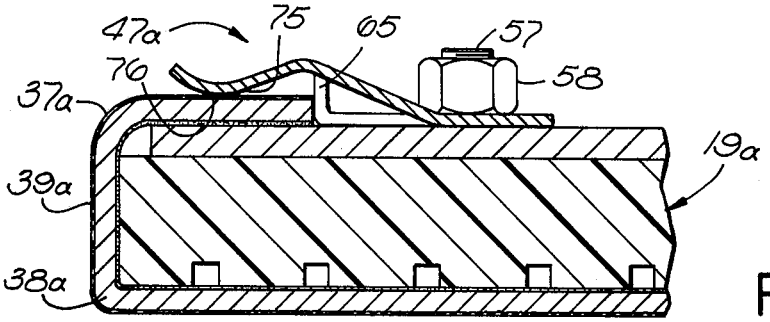
Figure 9:
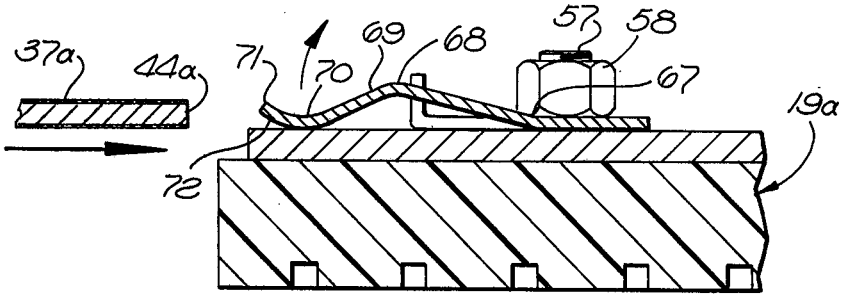
FIG. 9 is a view similar to FIG. 8, but showing the clip when no sandpaper is retained thereby.

The clip 47*a* of FIGS. 6 to 9 is desirably stamped from a single piece of slightly resiliently deformable sheet material, preferably spring steel, having a uniform thickness across its entire area, and cut and bent to have the outline configuration brought out best in FIG. 5 and the vertical sectional configuration illustrated in FIGS. 7 to 9. Referring particularly first to FIG. 6, the clip 47*a* as seen in top plan view has at its forward end a first spring urged clamping portion 45*a* which is elongated transversely of the main front to rear axis 20*a* of the tool to have a dimension *e* in that transverse direction almost as great as the transverse width *f* of shoe 19*a*. This forward clamping portion 45*a* of the clip merges at its rear side with two similar laterally spaced portions 46*a* of clip 47*a*, which portions 46*a* are elongated in generally the front to rear direction of axis 20*a*, and have relatively small width dimensions *g* transversely of axis 20*a*, much smaller than the discussed transverse width *e* of forward clamping portion 45*a*. These portions 46*a* function as leaf springs, which normally tend by their resilience to return the forward clamping portion 45*a* downwardly to the FIG. 9 position of engagement with the upper planar surface 25*a* of backing plate 23*a*.

The rear ends of springs 46*a* merge integrally with a rear anchoring portion 56 of clip 47*a*, which has a width transversely of axis 20*a* much greater than the springs 46*a*, and preferably corresponding to the width *e* of forward clamping portion 45*a*. At its opposite lateral extremities, anchoring portion 56 is held tightly against the upper surface of plate 23*a*, in fixed position relative thereto, by two screws 57, and coacting nuts 58, with the screws having lower enlarged heads 59 engaging upwardly against the underside of backing plate 23*a*. The shanks of these screws 57 project upwardly through openings 60 in plate 23*a*, and through openings 61 in clip 47*a*, for connection to the nuts 58 which are tightened downwardly against the clip. As seen in FIG. 6, each of the openings 61 in the mounting portion 56 of part 47*a* preferably takes the form of a slot 61, which is relatively narrow transversely of axis 20*a*, and is elongated in a front to rear direction parallel to axis 20*a*, to allow limited shifting movement of part 47*a* during initial assembly of the device to a position of precisely proper alignment with the front and side edges of shoe 19*a*.

At the locations of retaining screws 57, the anchoring portion 56 of the clip forms two forwardly projecting side fingers 62, defined at outer sides by parallel opposite side edges 63, and at their inner sides by parallel edges 64 extending in a front to rear direction and generally parallel to the opposite side edges of spring portions 46*a* of the device. At their forward ends, fingers 62 have upwardly turned vertical flange portions 65, which desirably lie in a common vertical plane 66 perpendicular to the front to rear axis 20*a* and perpendicular to the plane of upper surface 25*a* of the backing plate and undersurface 34*a* of cushion 24*a*. These flanges 65 are engageable with the edge 44*a* of sandpaper sheet 37*a* in the position of FIGS. 6 to 8 to limit the extent to which the sandpaper sheet can be inserted into the space beneath clamping portion or element 45*a*.

The entire mounting portion 56 of clip 47*a*, including its entire width between its opposite sides edges 63, and including the forwardly extending fingers 62 up to the locations of the forward flanges 65, is desirably planar to at all times be clamped tightly downwardly against and continuously engage the upper planar surface 25*a* of backing plate 23*a*. In extending forwardly from the flat fixed mounting portion 56, the two leaf spring portions 46*a* of part 47*a* advance gradually upwardly from the location 67 of FIG. 9, to a location 68 near the forward ends of springs 46*a* and near the forward movable clamping portion 45*a*. In advancing farther forwardly beyond the location 68, the material of part 47*a* extends downwardly at 69 to a valley location 70, and then curves back upwardly to a front edge 71 of part 47*a*. This upwardly concave sectional configuration of the forward portion 45*a* of part 47*a* is uniform across the entire width *e* of portion 45*a*, to present an inclined camming surface 72 at the underside of the forward portion of part 47*a* corresponding to the undersurface of portion 48 of the FIG. 4 device, for camming engagement with the edge 44*a* of sandpaper sheet 37*a* upon insertion of the sheet rearwardly into engagement with the clip.

As seen in FIG. 6, the forward clamping portion 45*a* of part 47*a* preferably has a somewhat greater front to rear dimension at a location between the two springs 46*a* than at locations laterally beyond those springs. More particularly, it is noted that the transverse edge 73 between springs 46*a* is desirably positioned slightly rearwardly of the corresponding rear edges 74 laterally outwardly of the springs.

In attaching the sheet 37*a* to shoe 19*a*, a user grasps the initially flat sandpaper sheet in the manner illustrated in FIG. 5, and represented fragmentarily at 37*a* in FIG. 9, and pushes the flat sheet rearwardly into engagement with camming surface 72 of the clip, to deflect the forward clamping portion 45*a* upwardly to its FIG. 8 position against the resilience of spring portions 46*a* of part 47*a*. The narrow springs 46*a* exert only a very light downward spring force, which is light enough to be overcome by the rearward force which can be exerted by paper 37*a* as discussed in connection with the first form of the invention. At the same time, the clamping force is sufficiently great to effectively hold the paper downwardly against the upper surface 25*a* of the shoe in the FIG. 8 assembled condition. The rearward movement of sandpaper 37*a* is limited at a predetermined position by engagement of the rear edge 44*a* of the paper with the vertical flanges 65 of clip 47*a*.

When the sandpaper reaches this fully inserted position, the paper is folded downwardly in the manner illustrated by the broken lines of FIG. 5, and is then folded rearwardly into engagement with the undersurface of cushion 24*a* for adhesive retention thereagainst. During operation of the power tool, the clip and the adhesive attachment of the paper to the shoe coact to hold the paper very positively in its retained position of FIGS. 6 to 8, to perform an effective sanding operation as the shoe reciprocates. When the paper has worn to a condition requiring replacement, its rear portion is stripped downwardly from the undersurface of the shoe, and then swung forwardly to a position in which the sheet may be pulled forwardly out of its retained position beneath the clip 47*a*. During the forward movement of the clamped portion of the paper sheet, the upwardly inclined configuration of the undersurface of the clip at the location designated by the number 75 in FIG. 8 enables the abrasive particles on the upper surface of the sheet to tend to cam portion 45*a* of part 47*a* slightly upwardly as the sheet moves forwardly, to minimize any resistance to such withdrawal of the sheet. Also, the upwardly concave sectional configuration of portion 45*a*, as illustrated in FIG. 8, results in an approximately line contact at 76 between the clip and paper in the clamped condition of the paper, to maximize the effectiveness of the clamping action.

While certain specific embodiments of the present invention have been disclosed as typical, the invention is of course not limited to these particular forms, but rather is applicable broadly to all such variations as fall within the scope of the appended claims.

I claim:

1. A portable abrading tool comprising:

a body adapted to be held and be manipulated by a user;

a shoe carried movably by said body and including a backing plate which is to extend essentially horizontally when abrading an upwardly facing work surface, and a cushion carried at the underside of said backing plate and having an undersurface;

an abrading sheet which is flexible but has some stiffness and which extends along the underside of said cushion and carries a layer of pressure sensitive adhesive at its upper side engaging the undersurface of said cushion and adhered thereto;

said undersurface of the cushion being formed of a substance to which said adhesive will adhere tightly in use but from which the adhesive can be stripped with said sheet for replacement;

said sheet extending upwardly at the forward end of said shoe and having an end portion doubled back generally rearwardly at the upper side of said backing plate;

a clamping element carried by said backing plate at its upper side near the forward end thereof;

means forming a clamping surface opposite said element defining therewith a space into which said end portion of the sheet projects generally rearwardly in a confined relation coacting with said adhesive in retaining the sheet during an abrading operation;

spring means yieldingly urging said clamping element relatively toward said opposed surface and toward a normal position of close enough proximity to said surface to require yieldingly resisted deflection of said clamping element relatively away from said surface upon sliding insertion of the sheet rearwardly therebetween;

said spring means being constructed to clamp said sheet between said element and said surface with a predetermined fixed spring force which is the same during sliding insertion of the sheet rearwardly between the element and surface as after the sheet reaches a fully inserted position in which it is retained by said spring force during an abrading operation;

said fixed spring force being light enough to enable a user while grasping said sheet manually at a location forwardly of said clamping element to push said end portion of the sheet rearwardly between the clamping element and opposed surface and to said fully inserted position, by force exerted from the hand of the user rearwardly through the flexible sheet, and against the frictional resistance offered by the lightly clamped retention of the sheet between the clamping element and said surface;

shoulder means positioned to engage an end edge of said abrading sheet and limit insertion thereof into said space between said clamping element and said surface; and a motor carried by said body and operable to power actuate said shoe and carried sheet relative to the body in an abrading motion while said element is clamped against said sheet with only said light fixed spring force which is exerted against the sheet during insertion.

2. An abrading tool as recited in claim 1, in which said surface opposite the clamping element is carried by said backing plate at its upper side and is beneath and faces upwardly toward the clamping element, said clamping element and said spring means being formed integrally from a common piece of resiliently deformable sheet material extending essentially along the upper side of said backing plate, said piece of sheet material having at least one relatively narrow leaf spring portion connected near one end to said backing plate and functioning as said spring means, with a wider portion of said piece of sheet material carried at the opposite end of said leaf spring portion and forming said clamping element, said wider portion having an upwardly inclined edge defining an entrance throat through which said sheet is insertable into said space, said piece of resiliently deformable sheet material being shaped to form said shoulder means positioned to engage an end edge of said abrading sheet and limit insertion thereof into said space between said clamping element and said surface.

3. An abrading tool as recited in claim 1, in which said clamping element and said spring means are portions of a single piece of resiliently deformable sheet material.

4. The combination as recited in claim 1, in which said clamping element has an angularly turned camming portion forming an entrance throat through which said sheet is insertable into said space between the clamping element and said surface, and by which said sheet deflects the clamping element away from said surface upon insertion into said space.

5. A portable abrading tool comprising:

a body adapted to be held and be manipulated by a user;

a shoe carried movably by said body and including a backing plate which is to extend essentially horizontally when abrading an upwardly facing work surface, and a cushion carried at the underside of said backing plate and having an undersurface;

an abrading sheet which is flexible but has some stiffness and which extends along the underside of said cushion and carries a layer of pressure sensitive adhesive at its upper side engaging the undersurface of said cushion and adhered thereto;

said undersurface of the cushion being formed of a substance to which said adhesive will adhere tightly in use but from which the adhesive can be stripped with said sheet for replacement;

said sheet extending upwardly at the forward end of said shoe and having an end portion doubled back generally rearwardly at the upper side of said backing plate;

a clip formed of sheet material and carried by said backing plate at its upper side near the forward end thereof;

said clip having an anchoring portion secured to said backing plate, a clamping portion forwardly of said anchoring portion and defining with an opposed upwardly facing surface carried by said backing plate a space into which said end portion of said abrading sheet projects, an upwardly inclined camming portion at the front of said clamping portion for camming engagement with said abrading sheet, and a plurality of leaf spring portions extending in a front to rear direction between and interconnecting said anchoring portion and said clamping portion and yieldingly urging said clamping portion downwardly toward a normal position of close enough proximity to said surface to require yieldingly resisted deflection of said clamping portion relatively away from said surface upon sliding insertion of said abrading sheet rearwardly therebetween;

said leaf spring portions being constructed to clamp said abrading sheet between said clamping portion and said surface with a predetermined fixed spring force which is the same during sliding insertion of the abrading sheet rearwardly between the clamping portion and surface as after the abrading sheet reaches a fully inserted position in which it is retained by said spring force during an abrading operation;

said fixed spring force being light enough to enable a user while grasping said abrading sheet manually at a location forwardly of said clamping portion to push said end portion of the abrading sheet rearwardly between the clamping portion and said surface and to said fully inserted position, by force exerted from the hand of the user rearwardly through the flexible abrading sheet, and against the frictional resistance offered by the lightly clamped retention of the abrading sheet between the clamping portion and said surface;

shoulder means carried by said anchoring portion of the clip for engaging an end edge of said abrading sheet to limit its inserting movement; and a motor carried by said body and operable to power actuate said shoe and carried sheet relative to the body in an abrading motion while said clip is clamped against said sheet with only said light fixed spring force which is exerted against the sheet during insertion.

6. An abrading tool as recited in claim 5, in which said leaf spring portions are bowed upwardly in extending between said anchoring portion and said clamping portion.

7. A portable abrading tool comprising:

a body adapted to be held and be manipulated by a user;

a shoe carried movably by said body and including a backing plate which is to extend essentially horizontally when abrading an upwardly facing work surface, and a cushion carried at the underside of said backing plate and having an undersurface to which an abrading sheet having a layer of pressure sensitive adhesive at its upper side is detachably connectable, with an end portion of the sheet being doubled back generally rearwardly at the upper side of the forward portion of the backing plate;

a clamping element carried by said backing plate at its upper side near the forward end thereof;

means forming a clamping surface opposite said element defining therewith a space into which said end portion of the sheet can project generally rearwardly in a confined relation coacting with said adhesive in retaining the sheet during an abrading operation;

spring means yieldingly urging said clamping element relatively toward said opposed surface and requiring yieldingly resisted deflection of said clamping element relative away from said surface upon sliding insertion of the sheet rearwardly therebetween;

said spring means being constructed to clamp said sheet between said element and said surface with a predetermined fixed spring force which is the same during sliding insertion of the sheet rearwardly between the element and surface as after the sheet reaches a fully inserted position in which it is retained by said spring force during an abrading operation;

said fixed spring force being light enough to enable a user while grasping said sheet manually at a location forwardly of said clamping element to push said end portion of the sheet rearwardly between the clamping element and opposed surface and to said fully inserted position, by force exerted from the hand of the user rearwardly through the flexible sheet, and against the frictional resistance offered by the lightly clamped retention of the sheet between the clamping element and said surface;

shoulder means positioned to engage an end edge of said abrading sheet and limit insertion of said sheet between said clamping element and said surface; and a motor carried by said body and operable to power actuate said shoe and carried sheet relative to the body in an abrading motion while said element is clamped against said sheet with only said light lixed spring force which is exerted against the sheet during insertion.

8. An abrading tool as recited in claim 7, in which said clamping element has an angularly disposed camming portion forming an entrance throat and engageable by said sheet to deflect said clamping element upon insertion of said sheet between the clamping element and said surface.

9. An abrading tool as recited in claim 7, in which said clamping element and said spring means are formed integrally as a single piece of sheet material having a forward portion functioning as said clamping element with an upwardly inclined front camming edge, said single piece of sheet material having a rear anchoring portion adapted to be attached to said plate, and a plurality of leaf spring portions extending between and interconnecting said clamping portion and said anchoring portion at laterally spaced locations.

10. The combination comprising:

a shoe including a backing plate which is to extend essentially horizontally when abrading an upwardly facing work surface, and a cushion carried at the underside of said backing plate and having an undersurface;

an abrading sheet which is flexible but has some stiffness and which extends along the underside of said cushion and carries a layer of pressure sensitive adhesive at its upper side engaging the undersurface of said cushion and adhered thereto;

said undersurface of the cushion being formed of a substance to which said adhesive will adhere tightly in use but from which the adhesive can be stripped with said sheet for replacement;

said sheet extending upwardly at the forward end of said shoe and having an end portion doubled back generally rearwardly at the upper side of said backing plate;

a clamping element carried by said backing plate at its upper side near the forward end thereof;

means forming a clamping surface opposite said element defining therewith a space into which said end portion of the sheet projects generally rearwardly in a confined relation coating with said adhesive in retaining the sheet during an abrading operation;

spring means yieldingly urging said clamping element relatively toward said opposed surface and toward a normal position of close enough proximity to said surface to require yieldingly resisted deflection of said clamping element relatively away from said surface upon sliding insertion of said sheet rearwardly between;

said spring means being constructed to clamp said sheet between said element and said surface with a predetermined fixed spring force which is the same during sliding insertion of the sheet rearwardly between the element and surface as after the sheet reaches a fully inserted position in which it is retained by said spring force during an abrading operation;

said fixed spring force being light enough to enable a user while grasping said sheet manually at a location forwardly of said clamping element to push said end portion of the sheet rearwardly between the clamping element and opposed surface and to said fully inserted position, by force exerted from the hand of the user rearwardly through the flexible sheet, and against the frictional resistance offered by the lightly clamped retention of the sheet between the clamping element and said surface; and locating means carried by said clamping element and projecting downwardly into a recess or recesses in said backing plate at a location to engage an end of said abrading sheet and limit insertion thereof into said space between the clamping element and said opposed surface.

11. The combination comprising:

a shoe including a backing plate which is to extend essentially horizontally when abrading an upwardly facing work surface, and a cushion carried at the underside of said backing plate and having an undersurface;

an abrading sheet which is flexible but has some stiffness and which extends along the underside of said cushion and carries a layer of pressure sensitive adhesive at its upper side engaging the undersurface of said cushion and adhered thereto;

said undersurface of the cushion being formed of a substance to which said adhesive will adhere tightly in use but from which the adhesive can be stripped with said sheet for replacement;

said sheet extending upwardly at the forward end of said shoe and having an end portion doubled back generally rearwardly at the upper side of said backing plate;

a clamping element carried by said backing plate at its upper side near the forward end thereof;

means forming a clamping surface opposite said element defining therewith a space into which said end portion of the sheet projects generally rearwardly in a confined relation coacting with said adhesive in retaining the sheet during an abrading operation;

spring means yieldingly urging said clamping element relatively toward said opposed surface and toward a normal position of close enough proximity to said surface to require yieldingly resisted deflection of said clamping element relatively away from said surface upon sliding insertion of said sheet rearwardly therebetween;

said spring means being constructed to clamp said sheet between said element and said surface with a predetermined fixed spring force which is the same during sliding insertion of the sheet rearwardly between the element and surface as after the sheet reaches a fully inserted position in which it is retained by said spring force during an abrading operation;

said fixed spring force being light enough to enable a user while grasping said sheet manually at a location forwardly of said clamping element to push said end portion of the sheet rearwardly between the clamping element and opposed surface and to said fully inserted position, by force exerted from the hand of the user rearwardly through the flexible sheet, and against the frictional resistance offered by the lightly clamped retention of the sheet between the clamping element and said surface;

said surface opposite the clamping element being carried by said backing plate at its upper side and being beneath and facing upwardly toward the clamping element;

said clamping element and said spring means being formed integrally from a common piece of resiliently deformable sheet material extending essentially along the upper side of said backing plate, said piece of sheet material having at least one relatively narrow leaf spring portion connected near one end to said backing plate and functioning as said spring means, with a wider portion of said piece of sheet material carried at the opposite end of said leaf spring portion and forming said clamping element, said wider portion having an upwardly inclined edge defining an entrance throat through which said sheet is insertable into said space, said piece of resiliently deformable sheet material being shaped to form shoulder means positioned to engage an end edge of said abrading sheet and limit insertion thereof into said space between said clamping element and said surface;

said shoulder means comprising lugs formed on said wider portion of said piece of sheet material and projecting downwardly into locating recesses in said backing plate and movable vertically therein and forming a plurality of shoulders lying essentially in a plane disposed transversely of the length of the backing plate and engageable with said end edge of said sheet to limit insertion thereof into said space.

12. The combination comprising:

a shoe including a backing plate which is to extend essentially horizontally when abrading an upwardly facing work surface, and a cushion carried at the underside of said backing plate and having an undersurface;

an abrading sheet which is flexible but has some stiffness and which extends along the underside of said cushion and carries a layer of pressure sensitive adhesive at its upper side engaging the undersurface of said cushion and adhered thereto;

said undersurface of the cushion being formed of a substance to which said adhesive will adhere tightly in use but from which the adhesive can be stripped with said sheet for replacement;

said sheet extending upwardly at the forward end of said shoe and having an end portion doubled back generally rearwardly at the upper side of said backing plate;

a clip formed of sheet material and carried by said backing plate at its upper side near the forward end thereof;

said clip having an anchoring portion secured to said backing plate, a clamping portion forwardly of said anchoring portion and defining with an opposed upwardly facing surface carried by said backing plate a space into which said end portion of said abrading sheet projects, an upwardly inclined camming portion at the front of said clamping portion for camming engagement with said abrading sheet, and a plurality of leaf spring portions extending in a front to rear direction between and interconnecting said anchoring portion and said clamping portion and yieldingly urging said clamping portion downwardly toward a normal position of close enough proximity to said surface to require yieldingly resisted deflection of said clamping portion relatively away from said surface upon sliding insertion of said abrading sheet rearwardly therebetween;

said leaf spring portions being constructed to clamp said abrading sheet between said clamping portion and said surface with a predetermined fixed spring force which is the same during sliding insertion of the abrading sheet rearwardly between the clamping portion and surface as after the abrading sheet reaches a fully inserted position in which it is retained by said spring force during an abrading operation;

said fixed spring force being light enough to enable a user while grasping said abrading sheet manually at a location forwardly of said clamping portion to push said end portion of the abrading sheet rearwardly between the clamping portion and said surface and to said fully inserted position, by force exerted from the hand of the user rearwardly through the flexible abrading sheet, and against the frictional resistance offered by the lightly clamped retention of the abrading sheet between the clamping portion and said surface;

the sheet material of said clip forming at least one projection extending forwardly from said anchoring portion of the clip at a location offset laterally from said leaf spring portions and carrying shoulder means for engaging an end edge of said abrading sheet to limit its inserting movement.

13. The combination comprising:

a shoe including a backing plate which is to extend essentially horizontally when abrading an upwardly facing work surface, and a cushion carried at the underside of said backing plate and having an undersurface;

an abrading sheet which is flexible but has some stiffness and which extends along the underside of said cushion and carries a layer of pressure sensitive adhesive at its upper side engaging the undersurface of said cushion and adhered thereto;

said undersurface of the cushion being formed of a substance to which said adhesive will adhere tightly in use but from which the adhesive can be stripped with said sheet for replacement;

said sheet extending upwardly at the forward end of said shoe and having an end portion doubled back generally rearwardly at the upper side of said backing plate;

a clip formed of sheet material and carried by said backing plate at its upper side near the forward end thereof;

said clip having an anchoring portion secured to said backing plate, a clamping portion forwardly of said anchoring portion and defining with an opposed upwardly facing surface carried by said backing plate a space into which said end portion of said abrading sheet projects, an upwardly inclined camming portion at the front of said clamping portion for camming engagement with said abrading sheet, and a plurality of leaf spring portions extending in a front to rear direction between and interconnecting said anchoring portion and said clamping portion and yieldingly urging said clamping portion downwardly toward a normal position of close enough proximity to said surface to require yieldingly resisted deflection of said clamping portion relatively away from said surface upon sliding insertion of said abrading sheet rearwardly therebetween;

said leaf spring portions being constructed to clamp said abrading sheet between said clamping portion and said surface with a predetermined fixed spring force which is the same during sliding insertion of the abrading sheet rearwardly between the clamping portion and surface as after the abrading sheet reaches a fully inserted position in which it is retained by said spring force during an abrading operation;

said fixed spring force being light enough to enable a user while grasping said abrading sheet manually at a location forwardly of said clamping portion to push said end portion of the abrading sheet rearwardly between the clamping portion and said surface and to said fully inserted position, by force exerted from the hand of the user rearwardly through the flexible abrading sheet, and against the frictional resistance offered by the lightly clamped retention of the abrading sheet between the clamping portion and said surface;

the sheet material of said clip forming two projections extending forwardly from said anchoring portion at opposite sides of said leaf spring portions and having upwardly turned forward ends forming shoulders essentially aligned transversely of the shoe for engaging and limiting inserting movement of an end edge of said abrading sheet.

14. The combination as recited in claim 13, including screws securing said anchoring portion of the clip to said backing plate at locations near said two projections respectively.

15. The combination comprising:

a shoe including a backing plate which is to extend essentially horizontally when abrading an upwardly facing work surface, and a cushion carried at the underside of said backing plate and having an undersurface to which an abrading sheet having a layer of pressure sensitive adhesive at its upper side is detachably connectable, with an end portion of the sheet being doubled back generally rearwardly at the upper side of the forward portion of the backing plate;

a clamping element carried by said backing plate at its upper side near the forward end thereof;

means forming a clamping surface opposite said element defining therewith a space into which said end portion of the sheet can project generally rearwardly in a confined relation coacting with said adhesive in retaining the sheet during an abrading operation;

spring means yieldingly urging said clamping element relatively toward said opposed surface and requiring yieldingly resisted deflection of said clamping element relatively away from said surface upon sliding insertion of the sheet rearwardly therebetween;

said spring means being constructed to clamp said sheet between said element and said surface with a predetermined fixed spring force which is the same during sliding insertion of the sheet rearwardly between the element and surface as after the sheet reaches a fully inserted position in which it is retained by said spring force during an abrading operation;

said fixed spring force being light enough to enable a user while grasping said sheet manually at a location forwardly of said clamping element to push said end portion of the sheet rearwardly between the clamping element and opposed surface and to said fully inserted position, by force exerted from the hand of the user rearwardly through the flexible sheet, and against the frictional resistance offered by the lightly clamped retention of the sheet between the clamping element and said surface; and at least one lug projecting from said clamping element into a locating recess in said backing plate and movable therein and engageable with an end edge of said sheet to limit insertion thereof between the clamping element and said surface.

16. The combination comprising:

a shoe including a backing plate which is to extend essentially horizontally when abrading an upwardly facing work surface, and a cushion carried at the underside of said backing plate and having an undersurface to which an abrading sheet having a layer of pressure sensitive adhesive at its upper side is detachably connectable, with an end portion of the sheet being doubled back generally rearwardly at the upper side of the forward portion of the packing plate;

a clamping element carried by said backing plate at its upper side near the forward end thereof;

means forming a clamping surface opposite said element defining therewith a space into which said end portion of the sheet can project generally rearwardly in a confined relation coacting with said adhesive in retaining the sheet during an abrading operation;

spring means yieldingly urging said clamping element relatively toward said opposed surface and requiring yieldingly resisted deflection of said clamping element relatively away from said surface upon sliding insertion of the sheet rearwardly therebetween;

said spring means being constructed to clamp said sheet between said element and said surface with a predetermined fixed spring force which is the same during sliding insertion of the sheet rearwardly between the element and surface as after the sheet reaches a fully inserted position in which it is retained by said spring force during an abrading operation;

said fixed spring force being light enough to enable a user while grasping said sheet manually at a location forwardly of said clamping element to push said end portion of the sheet rearwardly between the clamping element and opposed surface and to said fully inserted position, by force exerted from the hand of the user rearwardly through the flexible sheet, and against the frictional resistance offered by the lightly clamped retention of the sheet between the clamping element and said surface;

said clamping element and said spring means being formed integrally of a single piece of resilient material extending essentially along the upper side of said backing plate and having a relatively narrow portion forming a leaf spring and functioning as said spring means, and a wider portion functioning as said clamping element with an inclined camming portion at its forward end defining an entrance throat through which the sheet is insertable between the clamping element and said surface, said single piece of resilient material having two downwardly turned lugs received movably within two spaced recesses in said backing plate and forming shoulders engageable with an end edge of said sheet to limit its insertion into said space between the clamping element and said surface;

said surface being an upwardly facing top surface of said backing plate.

17. The combination comprising:

a shoe including a backing plate which is to extend essentially horizontally when abrading an upwardly facing work surface, and a cushion carried at the underside of said backing plate and having an undersurface to which an abrading sheet having a layer of pressure sensitive adhesive at its upper side is detachably connectable, with an end portion of the sheet being doubled back generally rearwardly at the upper side of the forward portion of the backing plate;

a clamping element carried by said backing plate at its upper side near the forward end thereof;

means forming a clamping surface opposite said element defining therewith a space into which said end portion of the sheet can project generally rearwardly in a confined relation coacting with said adhesive in retaining the sheet during an abrading operation;

spring means yieldingly urging said clamping element relatively toward said opposed surface and requiring yieldingly resisted deflection of said clamping element relatively away from said surface upon sliding insertion of the sheet rearwardly therebetween;

said spring means being constructed to clamp said sheet between said element and said surface with a predetermined fixed spring force which is the same during sliding insertion of the sheet rearwardly between the element and surface as after the sheet reaches a fully inserted position in which it is retained by said spring force during an abrading operation;

said fixed spring force being light enough to enable a user while grasping said sheet manually at a location forwardly of said clamping element to push said end portion of the sheet rearwardly between the clamping element and opposed surface and to said fully inserted position, by force exerted from the hand of the user rearwardly through the flexible sheet, and against the frictional resistance offered by the lightly clamped retention of the sheet between the clamping element and said surface;

said clamping element and said spring means being formed integrally as a single piece of sheet material having a forward portion functioning as said clamping element with an upwardly inclined front camming edge, said single piece of sheet material having a rear anchoring portion adapted to be attached to said plate, and a plurality of leaf spring portions extending between and interconnecting said clamping portion and said anchoring portion at laterally spaced locations;

said single piece of sheet material having projections extending forwardly from said anchoring portion at opposite sides of said leaf spring portions and carrying shoulders for engaging and limiting inserting movement of said abrading sheet; and screws extending through openings in said anchoring portion and securing it to said backing plate at locations near said projections.

18. For connection to the upper side of an abrading show, a clip comprising:

a body of resiliently deformable sheet material having a rear anchoring portion adapted to be secured to said abrading shoe, a forward clamping portion adapted to overlie an opposed upwardly facing surface on said shoe to define therewith a space into which an end edge of an abrading sheet is insertable rearwardly, and at least one leaf spring portion extending between and interconnecting said anchoring portion and said clamping portion and yieldingly urging the latter downwardly to clamp said abrading sheet during and after insertion with a fixed spring force which is light enough to enable a user to push the abrading sheet rearwardly beneath the yieldingly urged clamping portion by force exerted from the user's hand through the abrading sheet;

said clamping portion having a forward edge turned angularly upwardly for camming engagement with said abrading sheet.

said clamping portion having at least one downturned lug engageable with said edge of the abrading sheet in limiting relation.

19. For connection to the upper side of an abrading shoe, a clip comprising:

a body of resiliently deformable sheet material having a rear anchoring portion adapted to be secured to said abrading shoe, a forward clamping portion adapted to overlie an opposed upwardly facing surface on said shoe to define therewith a space into which an end edge of an abrading sheet is insertable rearwardly, and at least one leaf spring portion extending between and interconnecting said anchoring portion and said clamping portion and yieldingly urging the latter downwardly to clamp said abrading sheet during and after insertion with a fixed spring force which is light enough to enable a user to push the abrading sheet rearwardly beneath the yieldingly urged clamping portion by force exerted from the user's hand through the abrading sheet;

said clamping portion having a forward edge turned angularly upwardly for camming engagement with said abrading sheet;

said anchoring portion forming at least one projection extending forwardly at a location laterally offset from said leaf spring portion and carrying a shoulder engageable with an end edge of said sheet in a relation limiting inserting movement thereof.

20. For connection to the upper side of an abrading shoe, a clip comprising:

a body of resiliently deformable sheet material having a rear anchoring portion adapted to be secured to said abrading shoe, a forward clamping portion adapted to overlie an opposed upwardly facing surface on said shoe to define therewith a space into which an end edge of an abrading sheet is insertable rearwardly, and a plurality of leaf spring portions extending between and interconnecting said anchoring portion and said clamping portion at laterally spaced locations and yieldingly urging the latter downwardly to clamp said abrading sheet during and after insertion with a fixed spring force which is light enough to enable a user to push the abrading sheet rearwardly beneath the yieldingly urged clamping portion by force exerted from the user's hand through the abrading sheet;

said clamping portion having a forward edge turned angularly upwardly for camming engagement with said abrading sheet;

there being two projections extending forwardly from said anchoring portion at opposite sides of said leaf spring portions and having upwardly turned forward ends forming shoulders engageable with an end edge of said sheet to limit inserting movement thereof.

21. A clip as recited in claim 20, in which said anchoring portion contains apertures at essentially the rear ends of said projections for receiving fasteners to attach the clip to said shoe.

22. A portable abrading tool comprising:

a body adapted to be held and be manipulated by a user;

a shoe carried movably by said body and including a backing plate which is to extend essentially horizontally when abrading an upwardly facing work surface, and a cushion carried at the underside of said backing plate and having an undersurface;

an abrading sheet which is flexible but has some stiffness and which extends along the underside of said cushion and carries a layer of pressure sensitive adhesive at its upper side engaging the undersurface of said cushion and adhered thereto;

said undersurface of the cushion being formed of a substance to which said adhesive will adhere tightly in use but from which the adhesive can be stripped with said sheet for replacement;

said sheet extending upwardly at the forward end of said shoe and having an end portion doubled back generally rearwardly at the upper side of said backing plate;

a clamping element carried by said backing plate at its upper side near the forward end thereof;

means forming a clamping surface opposite said element defining therewith a space into which said end portion of the sheet projects generally rearwardly in a confined relation coacting with said adhesive in retaining the sheet during an abrading operation;

spring means yieldingly urging said clamping element relatively toward said opposed surface and toward a normal position of close enough proximity to said surface to require yieldingly resisted deflection of said clamping element relatively away from said surface upon sliding insertion of the sheet rearwardly therebetween;

said spring means being constructed to clamp said sheet between said element and said surface with a predetermined fixed spring force which is the same during sliding insertion of the sheet rearwardly between the element and surface as after the sheet reaches a fully inserted position in which it is retained by said spring force during an abrading operation;

said fixed spring force being light enough to enable a user while grasping said sheet manually at a location forwardly of said clamping element to push said end portion of the sheet rearwardly between the clamping element and opposed surface and to said fully inserted position, by force exerted from the hand of the user rearwardly through the flexible sheet, and against the frictional resistance offered by the lightly clamped retention of the sheet between the clamping element and said surface; and a motor carried by said body and operable to power actuate said shoe and carried sheet relative to the body in an abrading motion while said element is clamped against said sheet with only said light fixed spring force which is exerted against the sheet during insertion;

said clamping element and said spring means being portions of a single piece of resiliently deformable sheet material which is shaped to also form shoulder means engageable with an end edge of said abrading sheet in a relation limiting insertion thereof into said space.

* * * * *